US007114206B2

(12) United States Patent
Leach

(10) Patent No.: US 7,114,206 B2
(45) Date of Patent: Oct. 3, 2006

(54) MULTIPLE POSITION SYMMETRICALLY CONTOURED BODY PILLOW

(76) Inventor: Jamie S. Leach, 130 E. 10th St., P. O. Box 717, Ada, OK (US) 74820

( * ) Notice: Subject to any disclaimer, the term of this patent is extended or adjusted under 35 U.S.C. 154(b) by 3 days.

(21) Appl. No.: 10/870,645

(22) Filed: Jun. 17, 2004

(65) Prior Publication Data

US 2005/0278864 A1 Dec. 22, 2005

(51) Int. Cl.
*A47C 16/00* (2006.01)

(52) U.S. Cl. ..... 5/632; 5/652; 5/657

(58) Field of Classification Search ..... 5/630, 5/632, 633, 636, 637, 639, 652, 657
See application file for complete search history.

(56) References Cited

U.S. PATENT DOCUMENTS 2,795,802 A * 6/1957 Myers ..... 5/632
4,173,048 A * 11/1979 Varaney ..... 5/632
5,978,990 A * 11/1999 Akey ..... 5/632
6,052,848 A * 4/2000 Kelly ..... 5/632
6,088,854 A * 7/2000 Brownrigg ..... 5/632
6,457,195 B1 * 10/2002 Holste ..... 5/636
6,499,164 B1 * 12/2002 Leach ..... 5/632
6,874,183 B1 * 4/2005 Taylor ..... 5/632

* cited by examiner

*Primary Examiner*—Michael Trettel
(74) *Attorney, Agent, or Firm*—McAfee & Taft

(57) ABSTRACT

A multiple position contoured body pillow having an elongated somewhat oblong or oval shape adapted to conform to the spine and upper torso of a human user by means of a main body section consisting of a longitudinally extending back portion having a contoured inner peripheral edge and a substantially straight outer peripheral edge, transversely extending symmetrically curved U-shaped arms attached to the ends of the main body section which arms may be repositioned toward the main body section and which arms are adapted to "spring back" into position when abducted from the main body section of the pillow, the first symmetrically curved arm being provided at a terminal end thereof with a pocket adapted to contain a foldable fabric pouch for storing remote controls, small books, and the like.

7 Claims, 5 Drawing Sheets

MULTIPLE POSITION SYMMETRICALLY CONTOURED BODY PILLOW

BACKGROUND OF THE INVENTION

1. Field of the Invention

The present invention relates to a body pillow. More particularly, the present invention involves a multiple position contoured body pillow having an elongated somewhat oblong or oval shape. The pillow has a longitudinally extending back portion having a contoured inner peripheral edge adapted to fit the spinal curvature of a user and a substantially straight outer peripheral edge. The pillow is further provided with transversely extending symmetrically curved U-shaped arms attached to the ends of the main body section, the arms being adjustable such that they may be repositioned in an inward (toward the main body section) conformation. Each arm is designed in such a way that it "springs back" into position if pulled away, or abducted, from the main body section of the pillow to create the sensation of snugness against the body of a user. The first symmetrically curved arm is provided at the terminal end thereof with a pocket adapted to contain a foldable fabric pouch for storing remote controls, small books, and the like.

2. Prior Art

There are a number of patents that show or relate to body support pillows. It is believe to be novel to provide a multiple position contoured body pillow with hinged arms adapted to support the body of a person in a secure position while the person is seated or lying down.

A preliminary patentability search was conducted on this invention and the following listed references were uncovered in the search.

| Patent No. | Name | Date |
|---|---|---|
| Des. 201,492 | Jacobson | Jun. 29, 1965 |
| Des. 382,435 | Schaffner, et al. | Aug. 19, 1997 |
| Des. 409,038 | Rojas, Jr., et al. | May 4, 1999 |
| Des. 419,819 | Bartoli | Feb. 1, 2000 |
| Des. 420,845 | Rumage | Feb. 22, 2000 |
| Des. 431,745 | Jackson | Oct. 10, 2000 |
| Des. 453,653 | Tunnell | Feb. 19, 2002 |
| 3,899,797 | Gunst | Aug. 19, 1975 |
| 4,173,048 | Varaney | Nov. 6, 1979 |
| 4,624,021 | Hofstetter | Nov. 25, 1986 |
| 4,901,384 | Eary | Feb. 20, 1990 |
| 5,097,551 | Smith | Mar. 24, 1992 |
| 5,987,674 | Schaffner | Nov. 23, 1999 |
| 6,052,848 | Kelly | Apr. 25, 2000 |
| 6,088,854 | Brownrigg | Jul. 18, 2000 |
| 6,499,164 | Leach | Dec. 31, 2002 |

The above patents are not considered to be particularly pertinent to the present invention.

The Jackson patent (Des. 431,745) discloses a head and body pillow with a pocket attached at the top corner of the pillow.

Gunst U.S. Pat. No. 3,899,797 discloses an inflatable member which is adjustable to create various configurations and is used as a structural component for a piece of furniture.

Varaney U.S. Pat. No. 4,173,048 discloses a pillow having a substantially "U" shape which can encircle a user. Varaney has a uniform thickness preventing the pillow from retaining a "folded" position.

Hoffstetter U.S. Pat. No. 4,624,021 discloses a contoured cushion adapted to fit the torso and between the legs of a user.

Smith U.S. Pat. No. 5,097,551 discloses a contoured pillow adapted to provide skeletal support.

Kelly U.S. Pat. No. 6,052,848 is a "U" shaped pillow adapted to be positioned into a number of shapes to accommodate the user.

Leach U.S. Pat. No. 6,499,164 was issued to the present inventor and is a body pillow having a different shape than the present invention but a similar purpose.

SUMMARY OF THE INVENTION

The present invention involves a multiple position contoured body pillow comprising a longitudinally extending back portion having a contoured inner peripheral edge adapted to fit the spinal curvature of a user, a substantially straight outer peripheral edge, the back portion having a length of not less than thirty inches (30"), the back portion having a first and second end, the first and second ends having transversely extending symmetrically curved arms attached thereto, the symmetrically curved arms having an inner peripheral edge and an outer peripheral edge, the point of attachment of the transversely extending symmetrically curved arms being flexible so as to permit adjustment thereof, the point of attachment of the transversely extending symmetrically curved arms being designed such that they are resilient and spring back into their original position when pulled away, or abducted, from their original resting position so as to provide a "hinge" type movement or mild resistance of the arms for purposes of securing the body of a person utilizing the pillow without requiring the person to manually adjust the arms, the mild resistance feature further facilitating the maintenance of ideal positioning of the pillow for the desired body support, the transversely extending symmetrically curved arms being curved in a substantially "U" shape and forming a well along the interior curvature of each arm at its inner peripheral edge, the inner peripheral edge of each symmetrically curved arm being provided with a contoured portion adapted to conform to the body structure of a human user, the contoured portion expanding into a substantially straight portion which extends to the terminal end of each arm, the two symmetrically curved arms being of sufficient length that each arm contacts the other arm at the terminal ends thereof to form a complete substantially oblong or oval shape, and the first symmetrically curved arm being provided at the terminal end thereof with a pocket adapted to contain a foldable fabric pouch for storing remote controls, small books, and the like.

BRIEF DESCRIPTION OF THE DRAWINGS

FIG. 6 is an alternative view similar to FIG. 2 showing a foldable fabric pouch attached to a terminal end of the first transversely extending symmetrically curved arm for storing remote controls, portable or cellular telephones, and the like.

DETAILED DESCRIPTION OF THE PREFERRED EMBODIMENTS

Figure 1:
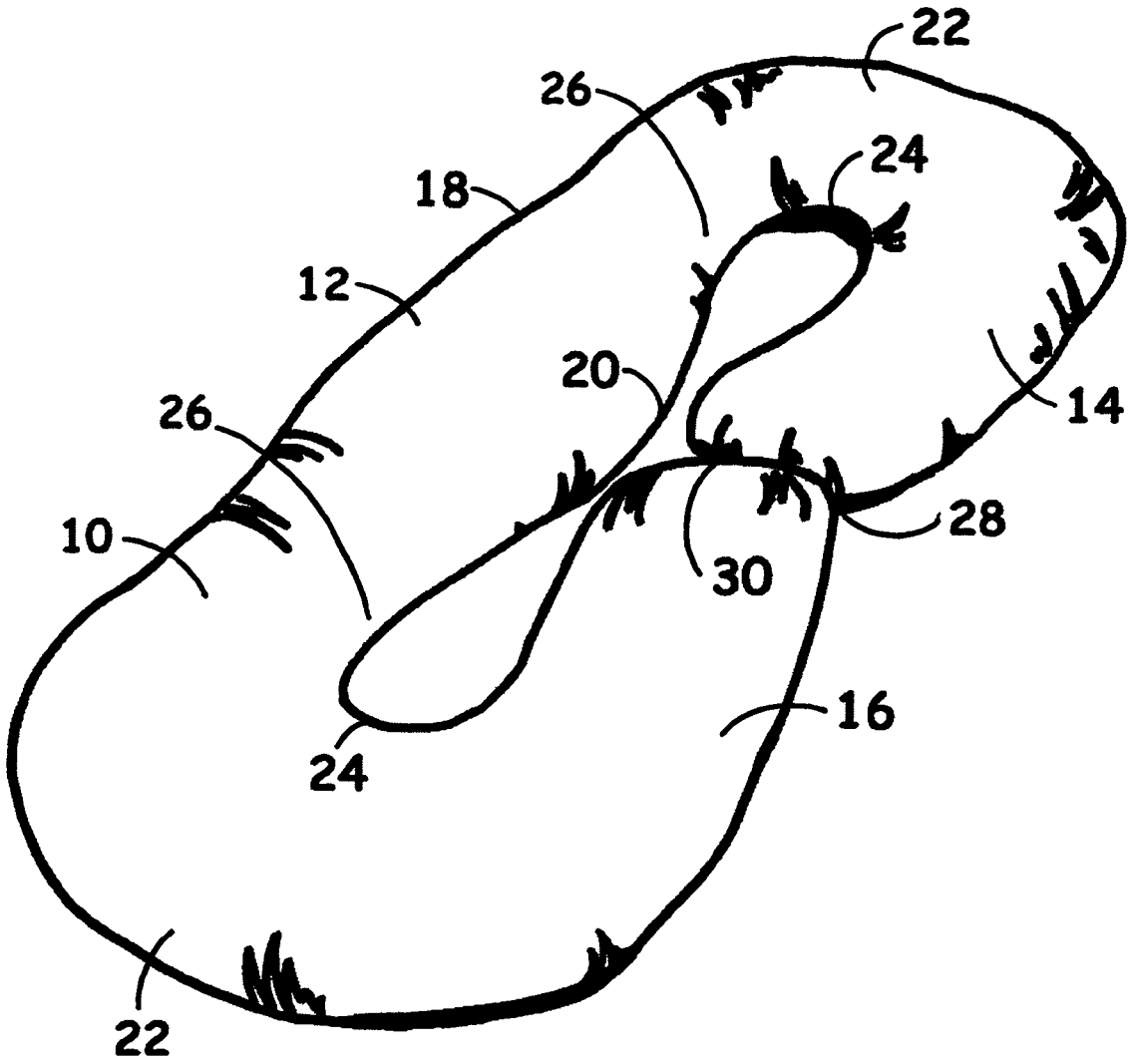
FIG. 1 is a perspective view showing the body pillow of the present invention laid out in a flat position.

Referring to the drawings in detail, FIG. 1 shows a multiple position contoured body pillow 10 laid out in a flattened position, the body pillow 10 comprising a back portion 12 having a length of not less than thirty inches (30") and consisting of a substantially straight outer edge 18 and a contoured inner edge 20, the back portion 12 narrowing at two points 26 where the back portion 12 transitions into symmetrically curved arms 14 and 16, each symmetrically curved arm 14 and 16 comprising an outer U-shaped portion 22 and an inner well 24, the symmetrically curved arms terminating at and end 28 and 30 thereof. In this position, the terminal ends 28 and 30 of the symmetrically contoured arms 14 and 16 body pillow 10

Figure 2:
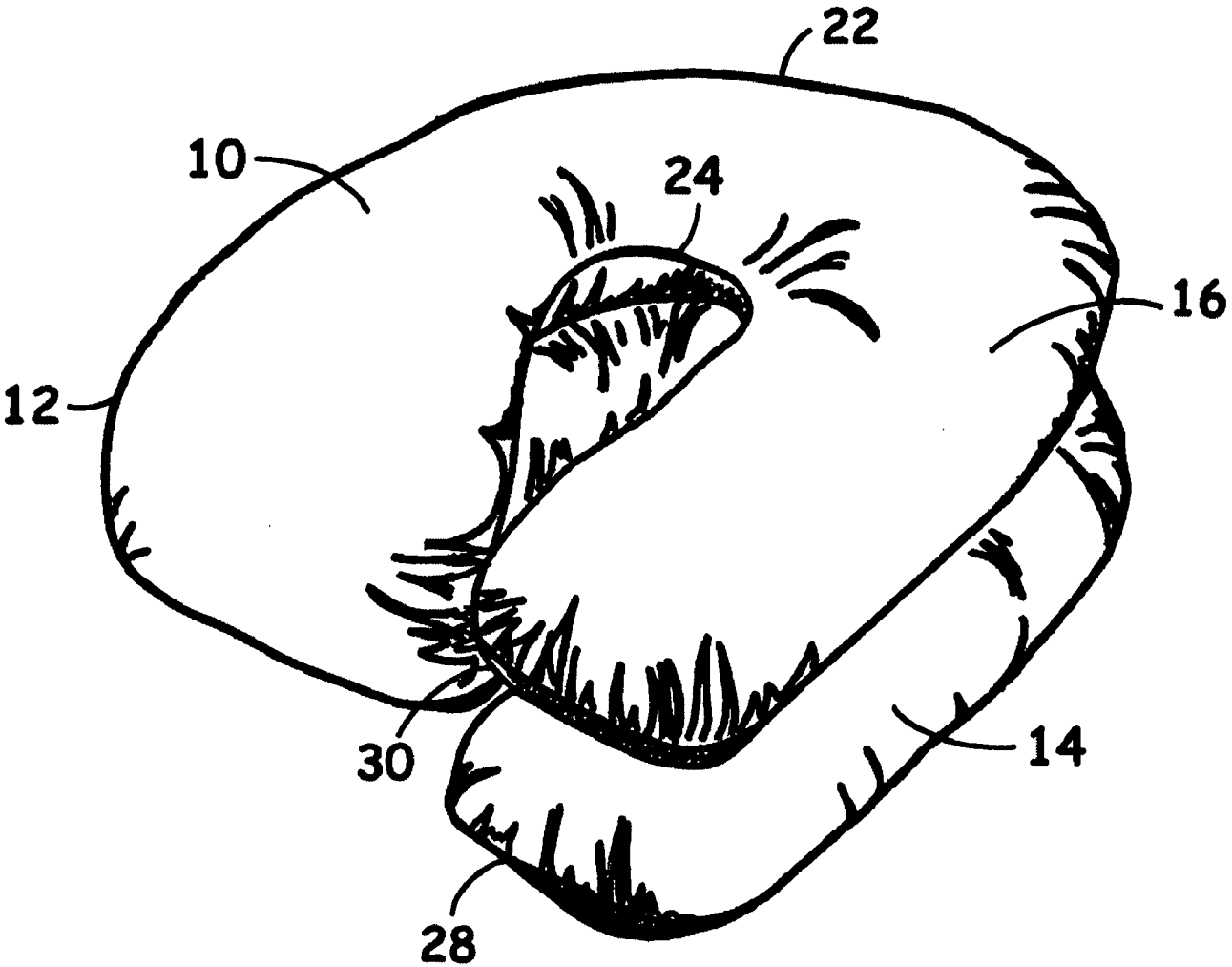
FIG. 2 is a front view showing the body pillow of the present invention folded over onto itself to create optimal back support for the user (not shown) in a seated position.

FIG. 2 shows the body pillow 10 in an alternate position of the body pillow 10 where the body pillow 10 has been folded in half to form a "double decker" or stacked support. This position is achieved by folding the body pillow 10 at the mid-section (not numbered) of the back portion 12 and stacking one symmetrical end comprising half of the back portion 12, the U-shaped portion 22 and the arm 16 (or 14 if the pillow were reversed) such that there is alignment between the wells 24 of each arm 14 and 16 and the terminal ends 28 and 30 of the body pillow 10. In this position, a human user (not shown in this Figure) sitting in an upright or semi-upright position would receive the wells 24 of the body pillow 10 around her middle and lower back with one arm resting on the symmetrically contoured arm 16 and the opposite arm resting on the topmost section of the back portion 12, the mild resistance feature would create tension between the folded back portion 12 and the arms 14 and 16, causing the arms to be effectively pulled toward, or adducted toward, the folded back portion 12 to surround the body of the human user (not shown).

Figure 3:
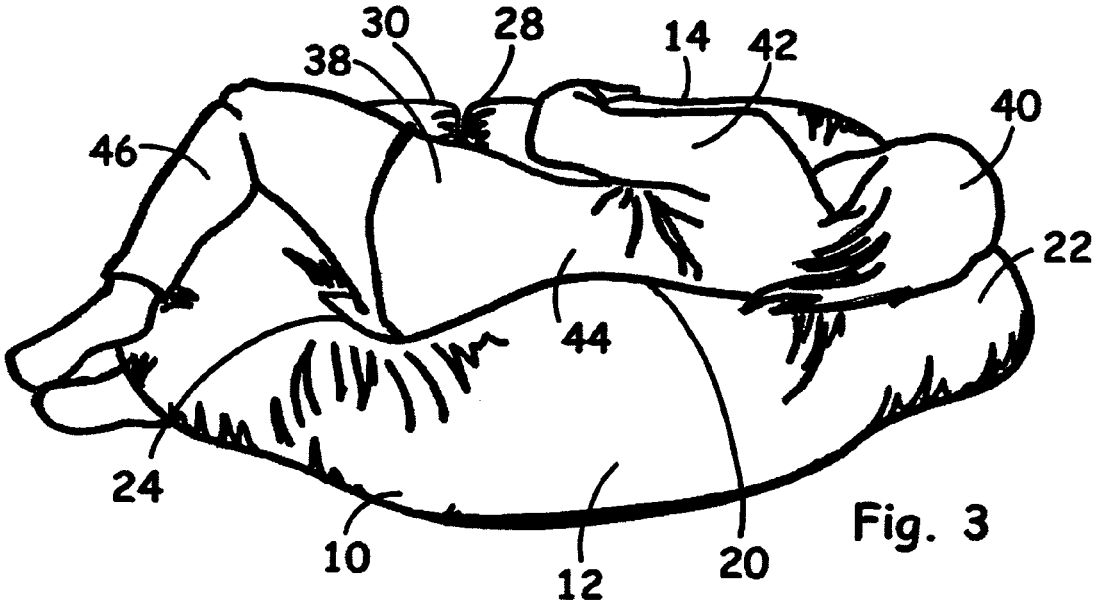
FIG. 3 is a rear view of the body pillow of the present invention showing the pillow conforming to the spine of a user lying on her side with her back resting against the longitudinally extending back portion of the pillow.

FIG. 3 shows the body pillow 10 of the present invention laid out in a position similar to that shown in FIG. 1, but with the addition of a human user 38 laying on her side. In this position, the head 40 of the user 38 is received against one of the U-shaped portions 22 with the neck and shoulder area (not numbered) of the user 38 resting along the well 24 of the body pillow 10, the opposite U-shaped portion 22 and the arm 16 are received between the legs 46 of the user 38, the contoured inner portion 20 of the back portion 12 corresponds to the curvature of the spine 44 of the user 38, while the arm 14 corresponds to the front torso (not numbered) of the user 38 and the arm 14 of the body pillow 10 is received between the arms 42 of the user 38. In this position, the terminal ends 28 and 30 of the arms 14 and 16, respectively, are brought together to form a complete enclosure around the body of the user 38 to create a feeling of security and aid in maintaining the desired position of the user 38.

Figure 4:
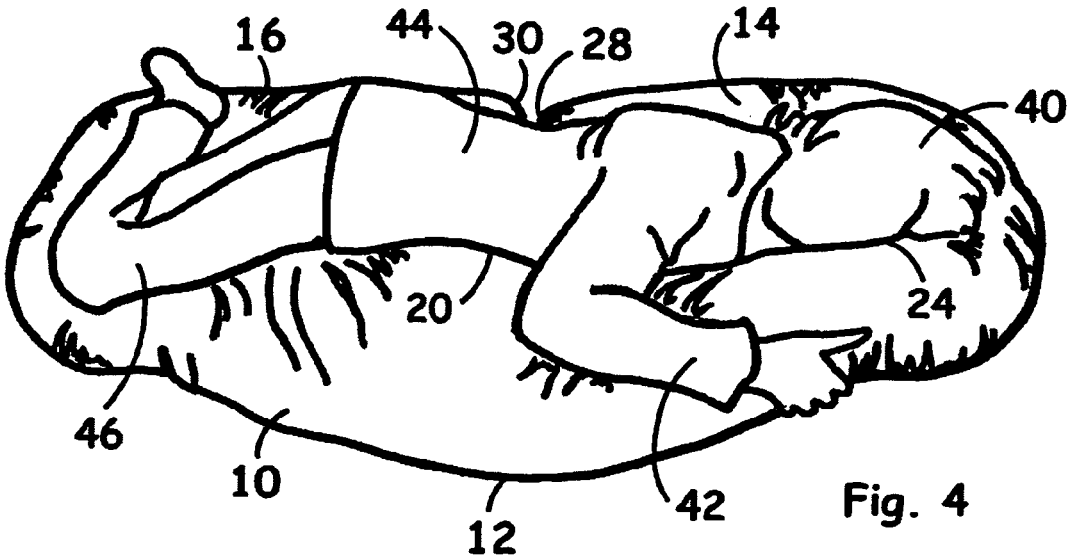
FIG. 4 is a rear view of the body pillow of the present invention showing the pillow conforming to the front torso region of a user lying on her side with her upper body resting against the longitudinally extending back portion of the pillow.

FIG. 4 is a view similar to FIG. 3, but shows the human user 38 turned in the opposite direction to that shown in FIG. 3. In this position, the head 40 of the user 38 is received against one of the U-shaped portions 22 with the neck and shoulder area (not numbered) of the user 38 resting along the well 24 of the body pillow 10, the opposite U-shaped portion 22 is received between the legs 46 of the user 38, the contoured inner portion 20 of the back portion 12 corresponds to the front upper torso (not numbered) of the user 38, while the arm 14 and the terminal ends 28 and 30 correspond to the spinal curvature 44 of the user 38 and the back portion 12 of the body pillow 10 is received between the arms 42 of the user 38. In this position, as indicated in FIG. 3, the terminal ends 28 and 30 of the arms 14 and 16, respectively, are brought together to form a complete enclosure around the body of the user 38 to create a feeling of security and aid in maintaining the desired position of the user 38.

Figure 5:
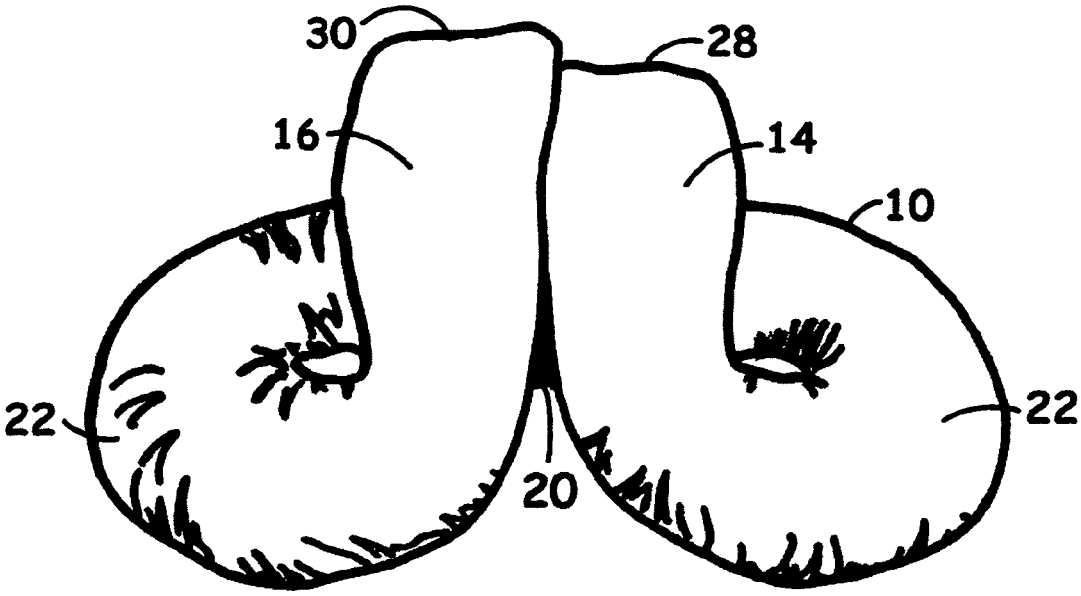
FIG. 5 is a front view of the body pillow of the present invention showing the transversely extending symmetrically curved arms brought to rest against each other, each transversely extending symmetrically curved arm being folded over and resting against the longitudinally extending back portion of the pillow.

FIG. 5 shows the body pillow 10 of the present invention in a second folded position whereby the back portion 12 of the body pillow 10 rests against a floor, bed, or other surface (not shown), the U-shaped portions 22 are moved inwardly with respect to the back portion 12 and the arms 14 and 16 are brought together in an upward position with the terminal ends 28 and 30 of the arms 14 and 16 bearing against each other to create a raised central section. In this embodiment, a user (not shown) will sit or lay with her back (or, alternatively, her stomach) against the arms 14 and 16 with her head resting against the terminal ends 28 and 30 and her arms may rest on the U-shaped portions 22.

Figure 6:
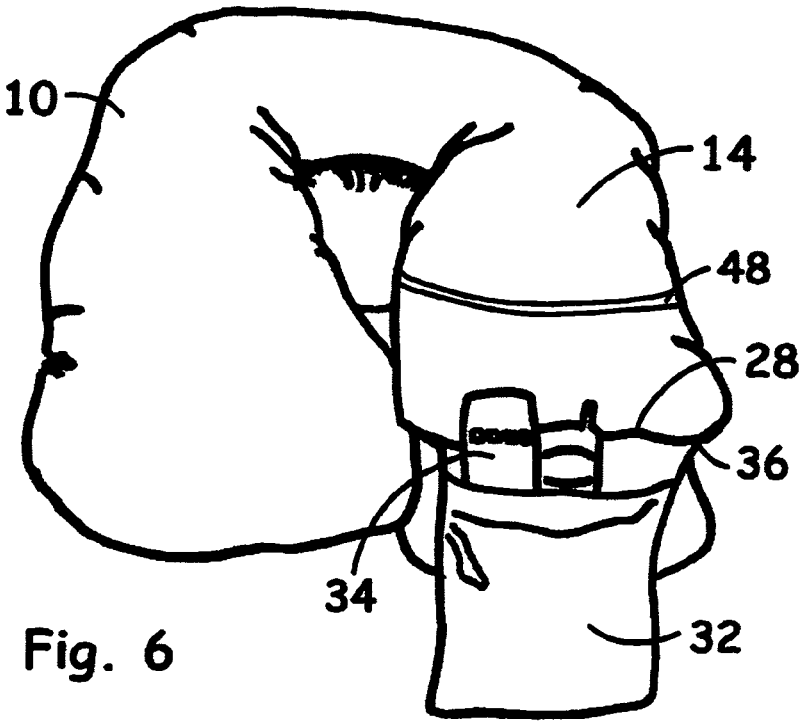

FIG. 6 shows the body pillow 10 of the present invention folded into a position similar to the position shown in FIG. 2 with the addition of a foldable pocket 32 which may be stitched into the seam 36 of the terminal end 28 (or 30, not shown) of the body pillow 10 for the purpose of holding small items such as a remote control 34 or portable telephone (not numbered). The covering material (not numbered) of the arm 14 (or 16, not shown) is provided with a section of overlapping or additional material 48 which is adapted to receive the foldable pocket 32 when the foldable pocket 32 is not in use.

Figure 7:
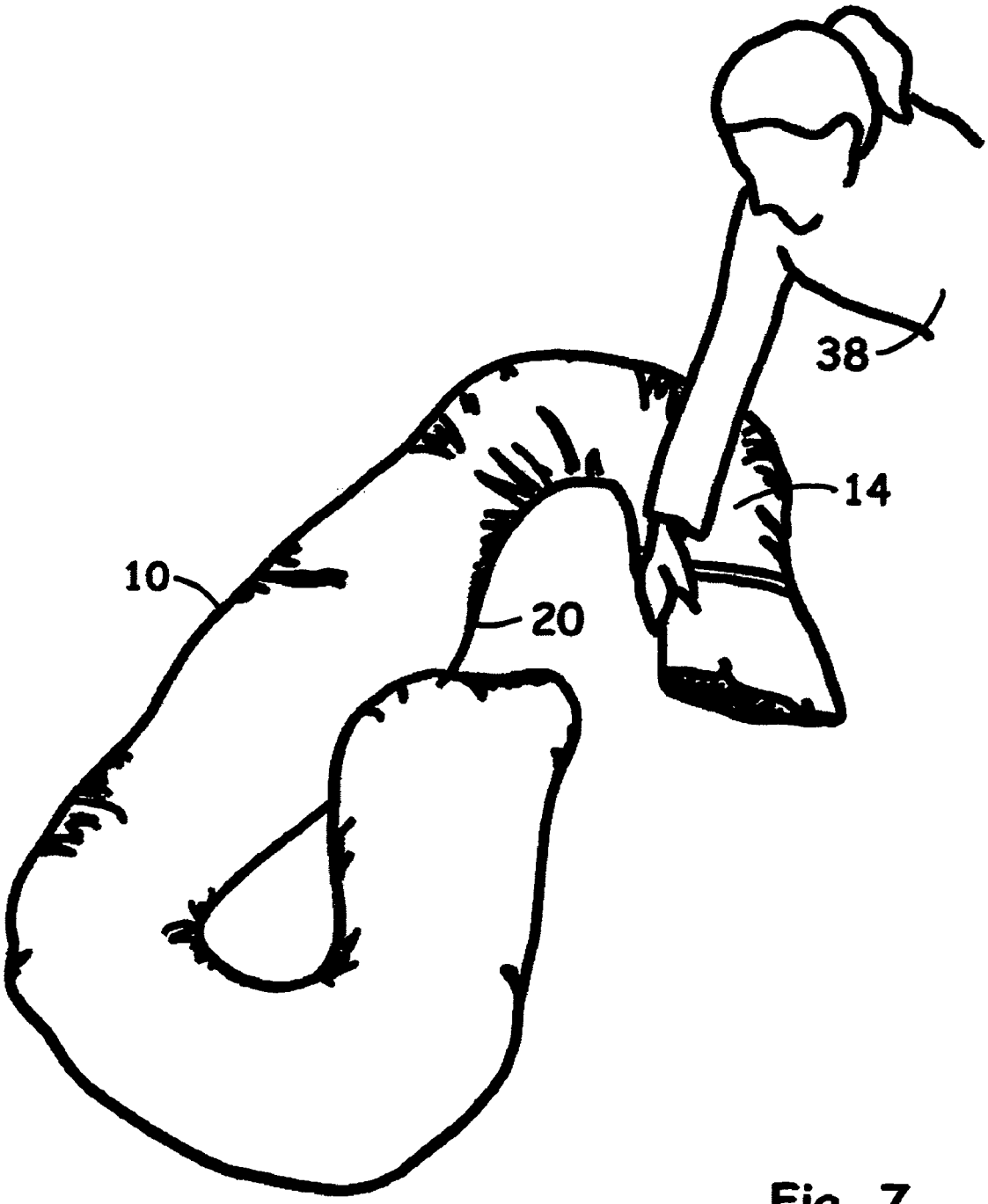
FIG. 7 is a perspective view showing a user demonstrating the "hinge" type movement of the arms for purposes of adjustability.

FIG. 7 shows the body pillow 10 of the present invention laid out in a substantially flat position with a user 38 abducting the arm 14 of the body pillow 10 from the contoured inner portion 20 of the back portion 14 creating a mild resistance between the contoured inner portion 20 and the arm 14. Once the arm 14 is released by the user 38, the mild resistance will cause the arm 14 to be adducted toward the contoured inner portion 20 (in a manner similar to spring action), restoring the body pillow 10 to its original shape.

What is claimed is:

1. A multiple position contoured body pillow having an elongated oblong or oval shape comprising a main body section including a longitudinally extending back portion having a length of not less than thirty inches (30"), the longitudinally extending back portion having a contoured inner peripheral edge adapted to fit the spinal curvature of a user, a substantially straight outer peripheral edge, transversely extending symmetrically curved U-shaped arms attached to the ends of the main body section, each arm being sufficiently long so as to contact the opposite arm at a terminal end thereof when the pillow is laid in a flat position.

2. A multiple position contoured body pillow as set forth in claim 1 wherein each arm is connected to the main body pillow such that it may be repositioned toward the main body section, each arm being designed such that it adducts to return to the original oblong or oval shape, when abducted from the main body section and subsequently released, by means of a mild resistance resulting from the shape of the pillow.

3. A multiple position contoured body pillow as set forth in claim 1 wherein the elongated oblong or oval shape of the pillow is adapted to conform to the body of a user to create a sensation of snugness and facilitate maintenance of the desired body position.

4. A multiple position contoured body pillow as set forth in claim 1 wherein a foldable fabric pouch is provided at a terminal end of one symmetrically curved arm for the purpose of storing small items in a convenient location.

5. A multiple position contoured body pillow as set forth in claim 4 wherein one symmetrically curved arm is provided at a terminal end thereof with a pocket adapted to contain a foldable fabric pouch.

6. A multiple position contoured body pillow as set forth in claim 1 wherein the pillow can be folded at a mid-section thereof with one half of the back portion and one arm resting immediately superior to the opposite half of the back portion and opposite arm to create a stacked support pillow.

7. A multiple position contoured body pillow as set forth in claim 1 wherein the arms of the pillow can be adducted toward and over the back portion of the pillow whereby the arms rest atop the back portion to create a raised central portion having lower portions to either side thereof.

* * * * *